United States Patent [19]

May

[11] 3,992,825

[45] Nov. 23, 1976

[54] SHEET TILE AND FIBER GLASS SHELL COMBINATION AND METHOD OF PRODUCING SAME

[76] Inventor: Ronald E. May, 780 Pearl St., Whiteland, Ind. 46184

[22] Filed: Nov. 24, 1975

[21] Appl. No.: 634,589

[52] U.S. Cl. ..... 52/35; 52/389; 52/146; 52/175; 52/747

[51] Int. Cl.[2] ..... A47K 3/16

[58] Field of Search ..... 52/34, 35, 384, 385, 52/390, 389, 388, 746, 747, 262; 4/185, 186, 145, 146, 173, 175

[56] References Cited

UNITED STATES PATENTS

| | | | |
|---|---|---|---|
| 2,993,212 | 7/1961 | Ruhn | 4/146 |
| 3,158,237 | 11/1964 | Schooler | 52/35 |
| 3,359,574 | 12/1967 | Stoneburner | 52/35 |
| 3,397,498 | 8/1968 | Murphy | 52/389 |
| 3,420,021 | 1/1969 | Anghinetti | 52/309 |

*Primary Examiner*—John E. Murtagh
*Attorney, Agent, or Firm*—Woodard, Weikart, Emhardt & Naughton

[57] ABSTRACT

The combination of a sheet of individual tiles attached together being mounted to a fiber glass shell and the method of constructing same. A plurality of panels are attached by adhesive means to a fiber glass shell. Each panel includes a plurality of individual tiles having edge portions attached to the edge portions of adjacent tile. The panels and the fiber glass shell are produced at a location remote from the final construction site. The fiber glass shell, configured as a shower stall or as a bathtub enclosure, is attached to a plurality of upright wooden studs. Tabs are provided on the fiber glass shell to receive conventional fastening devices extending into the studs. The fiber glass shell is provided with a rough, inwardly facing surface which adhesively receives the plurality of panels. In one embodiment, the shell includes a thickened top rib positioned flush with the panels whereas another embodiment includes a trim strip blending the panels into the shell. In yet another embodiment, recesses are provided in the bottom edge portion of the panels to receive fastening devices securing the shell to the studs with the fastening devices then being concealed by individual tiles received in the recesses.

10 Claims, 6 Drawing Figures

SHEET TILE AND FIBER GLASS SHELL COMBINATION AND METHOD OF PRODUCING SAME

BACKGROUND OF THE INVENTION

1. Field of the Invention

This invention is in the field of construction and more specifically, the construction of walls from tile.

2. Description of the Prior Art

Walls surrounding bathtubs and showers generally are provided with a plurality of individual tiles secured together providing a waterproof surface. It has been the practice to first construct a wall made of fiber glass and to then adhesively secure individual tiles to the wall. As a result, it is relatively costly to produce such a wall since each individual tile must be secured to the wall.

In order to reduce construction time, prefabricated shower shells are produced and then transported to the construction site. A liner for a shower stall is disclosed in U.S. Pat. No. 3,139,627 issued to H. L. Rice. Other shower stalls are disclosed in the U.S. Pat. Nos. 3,292,185 issued to A. N. Lucian; 3,609,773 issued to Bernard E. Mustee; and 3,869,734 issued to Bolt et al. Tiled walls are shown in the U.S. Pat. Nos. 3,616,466 issued to O. T. Davis, and 3,675,384 issued to Walter L. Knecht.

Individual tiles are also available in sheet form wherein the tiles are secured together forming a panel such as disclosed in U.S. Pat. No. 2,741,909 issued to W. Hartlmair. Disclosed herein is a new combination of a fiber glass shell which is produced at a location remote from the construction site with a panel of individual tiles secured together then being attached to the fiber glass shell at the construction site thereby reducing the time and expense of constructing various types of tiled walls. Also disclosed is the particular design of a fiber glass shell which is adapted for use with a shower or bathtub combination.

SUMMARY OF THE INVENTION

One embodiment of the present invention is a construction comprising a plurality of upstanding wooden studs, a fiber glass shell including a pair of fiber glass mats spaced apart by a layer of angel hair fiber glass with the mats and layer forming an integral assembly, at least one panel of sheet tile with the panel including before attachment to the shell a plurality of individual tiles having edge portions adhesively secured to adjacent edge portions of adjacent tile, waterproof adhesive means positioned between and securing together the panel to the shell, a tab attached to the shell, fastening means securing the tab to the wooden studs and drywall mounted to the wooden studs and extending adjacent to the panel with the tab being positioned between the drywall and the wooden studs.

Another embodiment of the present invention is a method of constructing a shower stall comprising the steps of erecting a plurality of wooden studs on a site, molding a fiber glass shower shell at a location remote from said site, transporting the shell to the site, producing a panel of individual tiles attached together at a location remote from the site, attaching the panel to the studs, transporting the panel to the site, and attaching the panel inwardly and to the shell.

It is an object of the present invention to provide a new combination of a fiber glass shell having panels of individual tiles secured to the shell.

A further object of the present invention is to provide a new and improved method of constructing a tiled wall.

Related objects and advantages of the present invention will be apparent from the following description.

DESCRIPTION OF THE PREFERRED EMBODIMENTS

Figure 1:
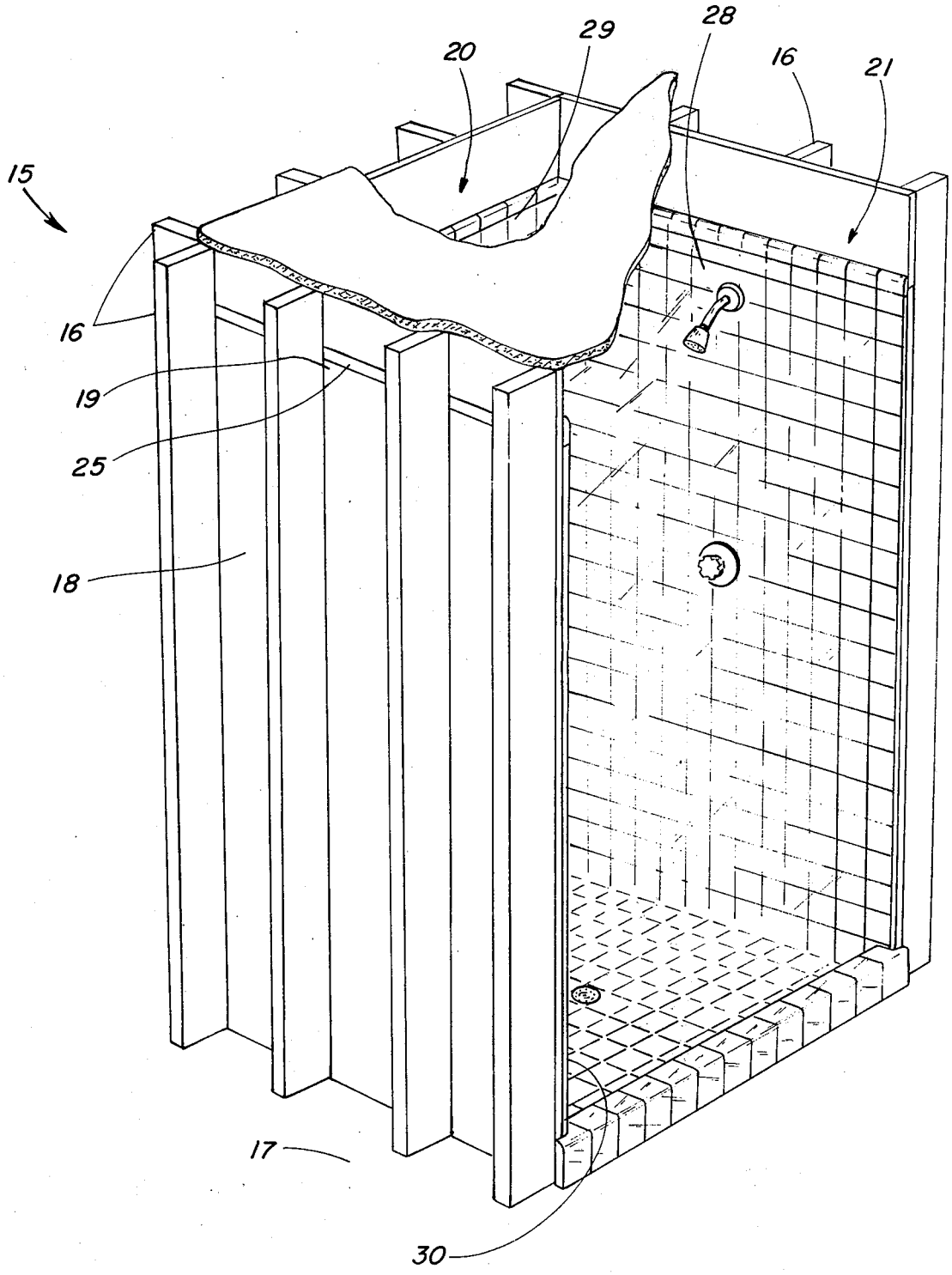
FIG. 1 is a fragmentary perspective view of a shower stall incorporating the present invention.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now more particularly to FIG. 1, there is shown a shower stall 15 having a plurality of upstanding wooden studs 16 fixedly mounted atop floor 17. A fiber glass shell 18 includes three walls 19, 20 and 21 joined perpendicularly together. Wall 21 will now be described, it being understood that a similar description applies to walls 19 and 20. Wall 21 (FIG. 2) includes a pair of fiber glass mats 22 and 23 spaced apart by a layer of angel hair fiber glass 24 with the mats and layer forming an integral wall. Such fiber glass shells are commercially available and are readily produced via the current technical knowledge.

The fiber glass shell is molded at a location remote from the site of construction of the building. The plurality of wooden studs are erected on the construction site with the fiber glass shell then being transported to the site. The fiber glass shell is then attached at the construction site to the upstanding wooden studs 16.

Figure 2:
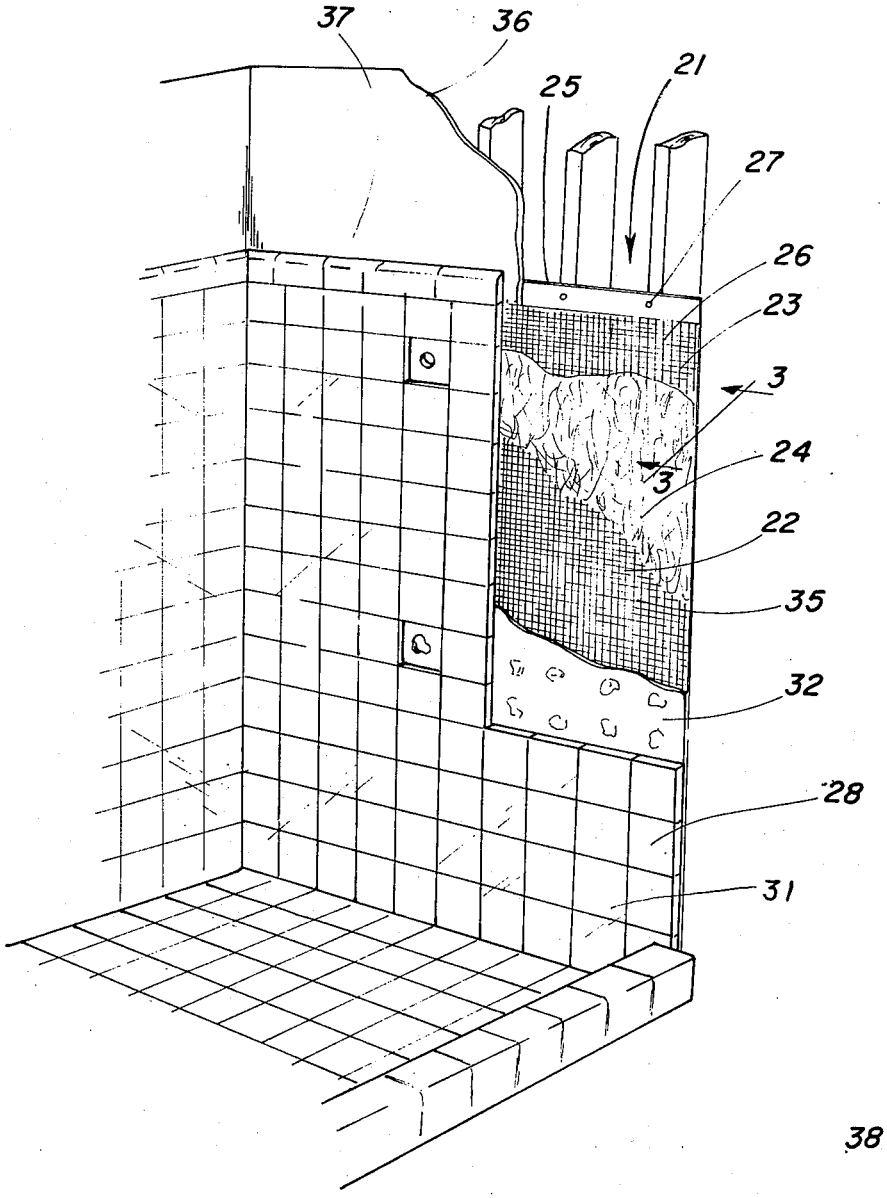
FIG. 2 is a fragmentary perspective view of a portion of one of the walls of the shower stall of FIG. 1.

In the embodiment shown in FIGS. 1 and 2, the fiber glass shell is attached by fastening metal tabs 25 to the wooden studs. Metal tab 25 is fixedly attached to the top edge portion 26 of walls 19, 20 and 21 during the fabrication of the shell 18. Apertures are provided in tab 25 allowing fasteners 27 to be extended therethrough thereby fixedly securing the tab to wooden studs 16.

At least one panel of sheet tile is attached to each wall 19 through 21. Panel 28 will now be described, it being understood that a similar description applies to panels 29 and 30. Panel 28 includes a plurality of individual tiles 31 with edge portions adhesively secured to adjacent edge portions of adjacent tile. Waterproof mastic adhesive 32 is positioned between and secures together the panels of tile to the fiber glass shell. For example, adhesive 32 secures panel 28 to wall 21. Panels 28 through 30 are produced at a site remote from the construction site thereby eliminating the necessity to secure individual tiles to the shower stall and instead allowing a complete panel of tiles to be secured to each fiber glass wall. Thus, the panels of tile are transported from a manufacturing facility to the construction site and attached to the fiber glass shell on the construction site. Each fiber glass wall 19 through 21 is provided with an inwardly facing rough surface 35 for attachment to the tile panel.

Each panel 28 through 30 covers respectively walls 19 through 21. For example, panel 28 extends from the floor of the stall to tab 25 and from panel 29 to the entrance opening of the stall.

Figure 3:
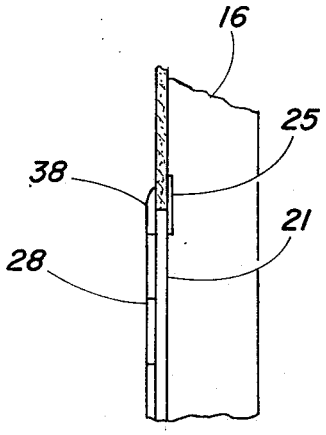
FIG. 3 is an enlarged cross-sectional view taken along the line 3—3 of FIG. 2 and viewed in the direction of the arrows.

Drywall is then mounted to the wooden studs above the shower stall with the drywall extending downwardly adjacent to the tile panels positioning tab 25 between the drywall and the wooden studs. For example, drywall 36 has a bottom edge portion 37 adjacent to panel 28 thereby concealing tab 25. The drywall is nailed to studs 16 and extends downwardly overlapping the tab. The drywall is glued to tab 25 at a position adjacent to the shell and is caulked to panel 28. As shown in FIG. 3, tab 25 is attached to the back surface of wall 21. The thickness of drywall 36 is less than the combined thickness of panel 28 and wall 21 and thus, a trim strip 38 is secured to drywall 36 immediately above panel 28 with the trim strip blending into drywall 36 having a top radiused edge. The drywall overlaps tab 25 and extends downwardly to a position adjacent wall 21. Trim strip 38 is produced from individual tiles secured together.

Figure 4:
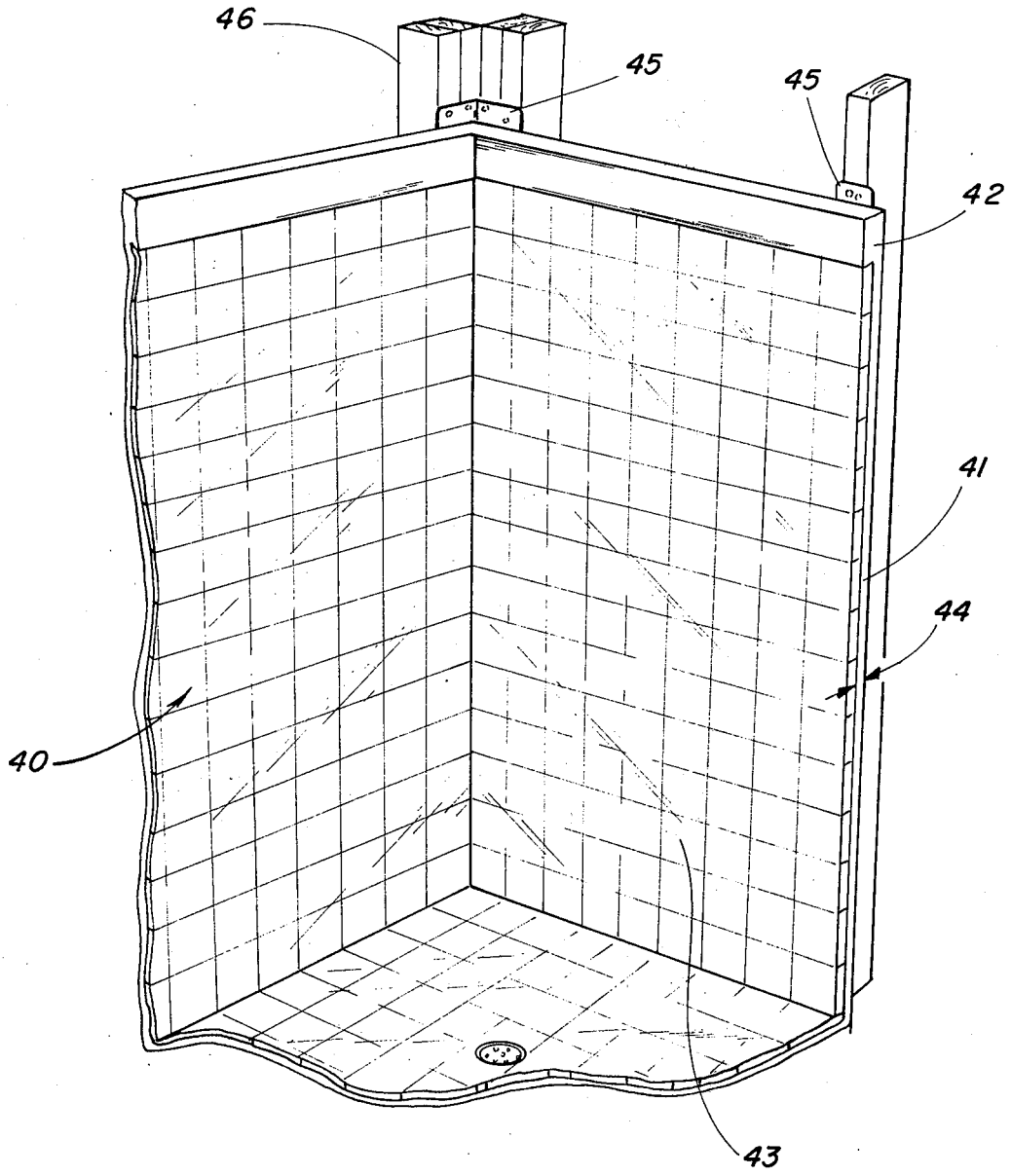
FIG. 4 is a fragmentary perspective view of an alternate embodiment of the shower stall of FIG. 1.

An alternate embodiment of the shower shell is shown in the fragmented view of FIG. 4. The shower shell has three sidewalls joined together in the manner shown in FIGS. 1 and 2. Likewise, panels of tiles are secured to the inwardly facing surface of each fiber glass wall. The embodiment shown in FIG. 4 includes, however, a thickened top edge portion eliminating the necessity for the trim strip 38 shown in the embodiment of FIG. 3.

Wall 41 of the shower stall 40 shown in FIG. 4 will now be described, it being understood that a similar description applies to the remaining walls of the shower shell. Wall 41 is produced from fiber glass in a manner identical to that described for wall 21. Wall 41 has a relatively constant thickness except for the top edge portion 42 which is thickened. The thickness of the top edge portion 42 is equal to the thickness of panel 43 secured to wall 41 plus the thickness 44 of wall 41 beneath the top edge portion 42. Thus, panel 43 blends into the thickened top edge 42.

Shower stall 40 is provided with a plurality of tabs 45 attached to the back surface of the shower stall. Tabs 45 are fastened to the upright wooden studs 46 in a manner identical to the attachment of tab 25 of the embodiment shown in FIGS. 1 and 2. The top edge portion 42 of wall 41 provides a top rib which is integrally attached to the main body of the fiber glass shell with the rib projecting inwardly to a position flush with the panels of tile attached to the shell. Tabs 45 project upwardly above the thickened top edge portion of the shell.

Figure 5:
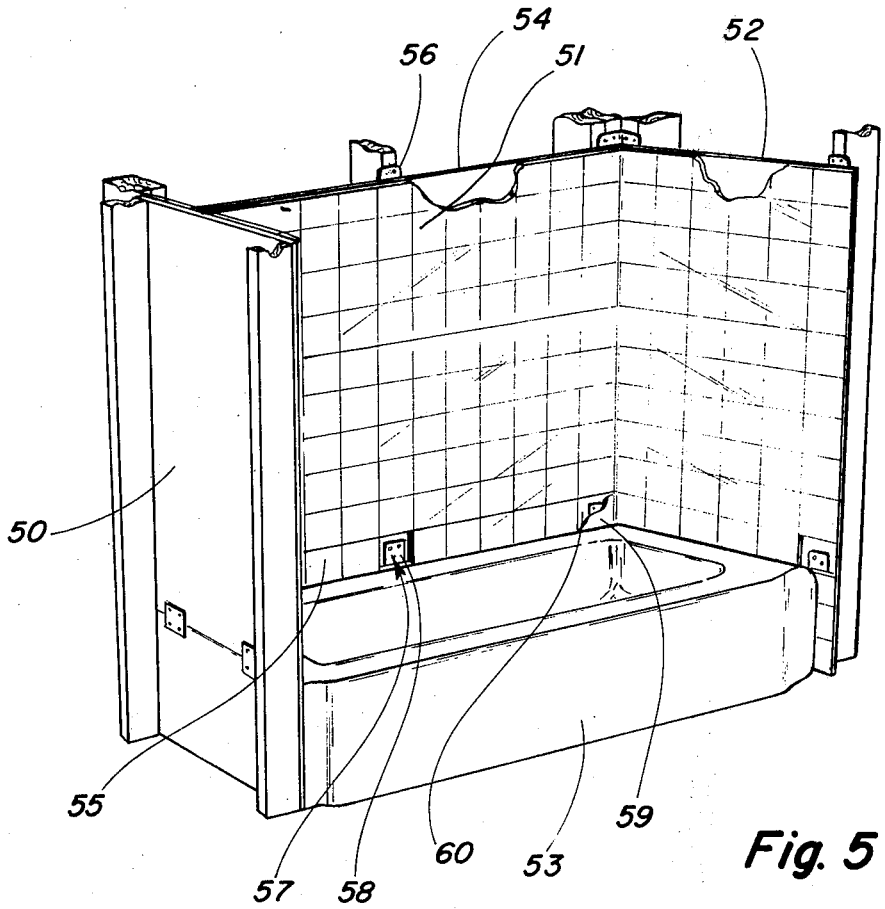
FIG. 5 is a fragmentary perspective view of an alternate embodiment of the present invention shown in combination with a bathtub.

The combination and method disclosed herein for producing a shower stall may also be used for producing three walls partially surrounding a bathtub as shown in FIG. 5. Walls 50, 51 and 52 are fixedly mounted above a conventional bathtub 53. Walls 50, 51 and 52 are identical with respect to wall 21 in that each wall includes a fiber glass wall having a panel of tiles secured thereto by adhesive in a manner identical to that described for the embodiment shown in FIGS. 1 and 2.

Wall 51 will now be described, it being understood that a similar description applies to walls 50 and 52. Wall 51 includes a fiber glass wall 54 produced from a pair of spaced apart fiber glass mats having a layer of angel hair fiber glass positioned therebetween forming an integral assembly. A panel 55 of sheet tile, with the panel including prior to attachment to wall 54 a plurality of individual tiles having edge portions adhesively secured to adjacent edge portions of adjacent tiles, is secured to wall 54 by a waterproof adhesive means. Tabs 56 are attached to the back surface of wall 54 for securing the wall to upright vertical studs. Conventional fastening devices such as nails are used to secure the tabs to the wooden studs.

Each panel of tiles for walls 50 through 52 includes a bottom edge portion with recesses thereon exposing the back fiber glass wall to allow fasteners to extend therethrough securing the fiber glass wall to the wooden studs. For example, panel 55 includes a recess 57 at the bottom edge portion of the panel with conventional fastening devices 58 extending through the fiber glass wall into the wooden studs. Individual tiles 59 are then positioned in the recesses and are secured to wall 54 so as to conceal fastening devices 58. For example, tiles 59 are positioned in recess 60 which is identical to recess 57.

Figure 6:
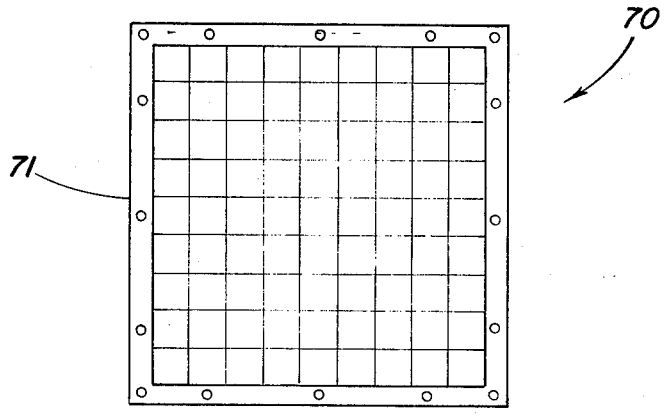
FIG. 6 is a front view of an alternate embodiment of wall 21 shown in FIG. 2.

In many cases, it may be desirable to provide fastening means extending entirely around the combination of the panel and the fiber glass wall. Such an embodiment is shown in FIG. 6 and is intended to replace a wall such as wall 21. Wall 70 is identical to wall 21 previously described except that tab 71, which is attached to the back surface of the fiber glass portion of wall 70, extends continuously and circumferentially around the panel.

As shown in FIG. 3, panel 28 has a height less than the height of the fiber glass wall 21 with the panel terminating beneath the top edge of wall 21. The trim strip is mounted inwardly of and adjacent the shell so as to rest against the panel.

The method of constructing the shower stall includes, in addition to the steps previously described, the providing of fastening tabs to and above the shell with the tabs then being attached to the studs. The drywall is attached to the studs and with the drywall being positioned adjacent the shell and against the tabs so as to conceal the tabs. The trim strips are attached to the shell adjacent and above the panel. The method is to be used for all types of shower and bathtub areas including mobile home showers and tub areas, single dwelling homes, multiple housing, including motels, hotels or any type of bathroom or shower. The combination disclosed herein provides a one-piece construction becoming a waterproof and mildew proof unit which is resistant to rot and stain. In one embodiment, the fiber glass walls have a thickness of ½ inch whereas the ceramic tile panel has a thickness of approximately ¼ inch. In the same embodiment, the floor of the shower stall was produced from a crystal glaze ceramic tile adhesively secured to fiber glass. The joints between adjacent panels are filled with Dow Corning 784 silicate sealant.

It will be obvious from the above description that the present invention eliminates the need for a tile setter on the construction site. The assembly can be installed by a plumber or builder and provides a 100 percent waterproof assembly. The flexible joints between adjacent panels will not crack, stain, or mildew. Likewise, the installation time is dramatically reduced due to the prefabrication of the panels.

Many variations are contemplated and included in the present invention. For example, in one embodiment, strengthening ribs of wood or masonite are positioned between the pair of fiber glass layers in place of the angel hair fiber glass previously described.

While the invention has been illustrated and described in detail in the drawings and foregoing description, the same is to be considered as illustrative and not restrictive in character, it being understood that only the preferred embodiments have been shown and described and that all changes and modifications that come within the spirit of the invention are desired to be protected.

The invention claimed is:

1. A construction comprising:

a plurality of upstanding wooden studs;

a fiber glass shell including a pair of fiber glass mats spaced apart by a layer of angel hair fiber glass with said mats and layer forming an integral assembly;

at least one panel of sheet tile with said panel including before attachment to said shell a plurality of individual tiles having edge portions adhesively secured to adjacent edge portions of adjacent tile;

waterproof adhesive means positioned between and securing together said panel to said shell;

a tab attached to said shell;

fastening means securing said tab to said wooden studs; and, drywall mounted to said wooden studs and extending adjacent to said panel with said tab being positioned between said drywall and said wooden studs.

2. The construction of claim 1 wherein:

said shell has an inwardly facing surface secured to said panel by said adhesive means, said inwardly facing surface provided with a rough texture.

3. The construction of claim 2 wherein:

said drywall is nailed to said studs and extends downwardly therefrom overlapping and glued to said tab to a position adjacent to said shell and caulked thereto.

4. The construction of claim 3 wherein:

said tab extends continuously and circumferentially around said panel;

said panel and said shell have a combined thickness greater than said drywall with said panel having a height less than said shell with said panel terminating at a location beneath said drywall; and further comprising:

a trim strip mounted inwardly of and against said shell and adjacent and above said panel, said trim strip having a top radiused edge portion extending to said drywall.

5. The combination of claim 1 wherein:

said shell includes a main body and a top rib integrally attached to said main body, said top rib projects inwardly to a position flush with said panel eliminating the need for a trim strip atop said panel, said tab projects upwardly above said rib.

6. The combination of claim 1 wherein:

said panel includes a bottom edge portion with recesses therein exposing said shell and further comprising:

fastening means positioned in said recesses securing said shell to said studs;

individual tiles positioned in said recesses and secured to said shell and said panel.

7. The combination of claim 6 and further comprising:

a bathtub positioned beneath and attached to said shell.

8. The combination of claim 4 wherein said shell is configured as a shower stall.

9. A method of constructing a shower stall comprising the steps of:

erecting a plurality of wooden studs on a site;

molding a fiber glass shower shell at a location remote from said site;

transporting said shell to said site;

producing a panel of individual tiles attached together at a location remote from said site;

transporting said panel to said site; and, attaching said panel inwardly and to said shell

10. The method of claim 9 comprising the additional steps of:

providing fastening tabs to and above said shell;

attaching said tabs to said studs;

attaching drywall to said studs and positioning said drywall adjacent said shell and against said tabs to conceal said tabs; and, attaching a trim strip to said shell adjacent and above said panel.

* * * * *